US011629938B1

(12) United States Patent
Deng et al.

(10) Patent No.: US 11,629,938 B1
(45) Date of Patent: Apr. 18, 2023

(54) SUSPENDED CATAMARAN TARGET BOAT

(71) Applicants: Sun Yat-sen University, Guangdong (CN); Southern Marine Science and Engineering Guangdong Laboratory (Zhuhai), Guangdong (CN)

(72) Inventors: Rui Deng, Guangdong (CN); Fuqiang Luo, Guangdong (CN); Tiecheng Wu, Guangdong (CN); Zhijie Song, Guangdong (CN); Hang Ren, Guangdong (CN); Xiang Yu, Guangdong (CN); Hailong Liu, Guangdong (CN); Hao Li, Guangdong (CN); Sichong Huang, Guangdong (CN)

(73) Assignees: Sun Yat-sen University, Guangzhou (CN); Southern Marine Science and Engineering Guangdong Laboratory (Zhuhai), Zhuhai (CN)

( * ) Notice: Subject to any disclaimer, the term of this patent is extended or adjusted under 35 U.S.C. 154(b) by 0 days.

(21) Appl. No.: 17/979,969

(22) Filed: Nov. 3, 2022

(51) Int. Cl.

| | |
|---|---|
| ***F41J 9/04*** | (2006.01) |
| ***B63B 17/00*** | (2006.01) |
| ***B63B 1/14*** | (2006.01) |
| ***B63B 79/10*** | (2020.01) |

(52) U.S. Cl.
CPC ..... *F41J 9/04* (2013.01); *B63B 1/14* (2013.01); *B63B 17/0081* (2013.01); *B63B 79/10* (2020.01)

(58) Field of Classification Search
CPC ..... F41J 9/04; B63B 1/14; B63B 17/0081; B63B 79/10
See application file for complete search history.

(56) References Cited

U.S. PATENT DOCUMENTS

| | | | | |
|---|---|---|---|---|
| 2007/0151494 | A1* | 7/2007 | Carnevali | B63B 17/0081 114/283 |
| 2011/0203507 | A1* | 8/2011 | Elinor | B63B 25/00 114/61.22 |
| 2017/0088235 | A1* | 3/2017 | Monk | B63B 27/14 |
| 2019/0092435 | A1* | 3/2019 | Longman | B63B 1/14 |

FOREIGN PATENT DOCUMENTS

| | | | | |
|---|---|---|---|---|
| CN | 101370707 A | * | 2/2009 | B63B 1/10 |
| CN | 104943818 A | * | 9/2015 | |
| CN | 206155737 U | * | 5/2017 | |

(Continued)

*Primary Examiner* — Anthony D Wiest

(57) ABSTRACT

The invention provides a suspended catamaran target boat, including a deck, a suspension structure and two buoyancy units, the suspension structure is connected to upper sides of the two buoyancy units, and the deck is mounted on the suspension structure; the suspension structure includes at least two suspension assemblies including an upper base, a lower base and two support rods. The support rods are hinged between the upper base and the lower base, and the upper base, the lower base and the two support rods form a four-bar linkage mechanism, where a shock absorber and a restricting mechanism are installed between the upper base and the lower base. The deck is provided with a main controller, an acceleration sensor and a heel sensor, and the main controller is respectively electrically connected with the acceleration sensor, the heel sensor and each of the restricting mechanisms of the two suspension assemblies.

8 Claims, 3 Drawing Sheets

(56) References Cited

FOREIGN PATENT DOCUMENTS

| | | | | | |
|---|---|---|---|---|---|
| CN | 206155737 | U | | 5/2017 | |
| CN | 107719592 | A | * | 2/2018 | ..... B63B 1/121 |
| CN | 109367729 | A | * | 2/2019 | ..... B63B 35/00 |
| JP | 2016216014 | A | * | 12/2016 | |

* cited by examiner

SUSPENDED CATAMARAN TARGET BOAT

CROSS REFERENCE TO RELATED APPLICATIONS

The present application claims the benefit of Chinese Patent Application No. 202210046284.2 filed on Jan. 14, 2022, the contents of which are incorporated herein by reference in their entirety.

TECHNICAL FIELD

The invention relates to the technical field of target boats, in particular to a suspended catamaran target boat.

BACKGROUND

A target boat refers to a boat specially used for firing training at sea, equipped with a target, a radar reflector or an infrared source simulator. The target boats are usually divided into tow target boats and self-propelled target boats, and self-propelled target boats have the characteristics of high speed and good moving performance in water.

For example, the Chinese utility model patent CN206155737U authorized on 2017 May 10 discloses a target ship, and specifically discloses that the target ship includes a target ship platform, a target ship equipment installation base and a target ship navigation equipment. The ship platform includes a pair of buoyancy components parallelly arranged, a plurality of connecting beam components, a plurality of platform deck meshes, a cockpit and a power unit; the buoyancy components are arranged along the length direction of the target ship platform to form a double-body structure; the connecting beam components are detachably connected in turn along the length direction of the target ship, while detachably connecting with the buoyancy components respectively, to achieve support and connection; the platform deck mesh is installed on the connecting beam component to cover it; the power unit is connected with the connecting beam components to form an assembly, and the cockpit is mounted on the deck platform.

The target ship in the prior art adopts a modular design, which can realize rapid assembly and disassembly of the target ship. It can be seen that the existing target ship mainly uses a skeleton and the simple buoyancy units for assembly, focusing on expandability and assembly-flexibility of the target ship structure. However, the structural reliability of the entire target ship is low. Even if it has self-propulsion capability, it can only simulate targets with low-speed in straight-line navigation, and cannot realize high-speed navigation of maneuverability and stability.

SUMMARY OF THE INVENTION

Regarding to the above problems, the present invention aims to provide a suspended catamaran target boat, so as to solve the problem that the target boat having low structural reliability can only simulate low-speed target movement in straight-line navigation, and cannot achieve good maneuverability and stability, even if it has self-propelled capability.

Technical scheme of a suspended catamaran target boat of the present invention is as follows:

A suspended catamaran target boat includes a deck, a suspension structure and two buoyancy units, where the two buoyancy units are arranged in parallel and spaced apart, and the suspension structure is connected to upper sides of the two buoyancy units, the deck is mounted on the suspension structure;

the suspension structure includes at least two suspension assemblies, the at least two suspension assemblies each include an upper base, a lower base and two support rods, the upper base and the lower base are arranged apart in an up-down direction, the upper base is fixedly connected with the deck, and the lower base is fixedly connected with a corresponding buoyancy unit;

The two support rods are arranged apart along a width direction of the deck, and the two support rods are hinged between the upper base and the lower base; the upper base, the lower base and the two support rods form a four-bar linkage mechanism, and a shock absorber and a restricting mechanism are installed between the upper base and the lower base;

The deck is provided with a main controller, an acceleration sensor and a heel sensor, and the main controller is respectively electrically connected to the acceleration sensor, the heel sensor and the restricting mechanisms of the two suspension assemblies;

The acceleration sensor is arranged at the front of the deck to detect a gravitational acceleration of a bow section; the main controller is preset with an acceleration threshold, and is configured to receive an electrical signal of the gravitational acceleration and compare the gravitational acceleration with the acceleration threshold, so as to control the restricting mechanisms to restrict a maximum allowable length of the shock absorbers to a corresponding value when the gravitational acceleration reaches the set acceleration threshold;

At least two heel sensors are provided, and the at least two heel sensors are arranged on both sides of the deck along its width direction to detect a heel angle of the deck towards a corresponding side; the main controller is preset with a heel angle threshold, and is configured to receive an electric signal of the heel angle, so as to control the restricting mechanism of the suspension assembly on a corresponding side to restrict the maximum allowable length of the shock absorber to a corresponding value when the heel angle reaches the set heel angle threshold.

Further, four suspension assemblies are provided, which are two left suspension assemblies and two right suspension assemblies respectively, and the left suspension assemblies and the right suspension assemblies are symmetrically arranged with respect to a central axis of the deck, and the left suspension assemblies and the right suspension assemblies are arranged in an outwardly expanding shape from top to bottom.

Further, the upper base is provided with a first hinge part and a second hinge part, and the first hinge part and the second hinge part are arranged apart along a width direction of the deck;

The lower base is provided with a third hinge part and a fourth hinge part, and the third hinge part and the fourth hinge part are arranged apart along a width direction of the deck;

The first hinge part and the third hinge part are connected through a first support rod, and the second hinge part and the fourth hinge part are connected through a second support rod.

Further, a distance between the first hinge part and the second hinge part is D1, a distance between the third hinge part and the fourth hinge part is D2, and D1=D2; a length of the first rod is L1, a length of the second rod is L2, and L1=L2.

Further, the restricting mechanism is connected between the first hinge part and the fourth hinge part, the shock absorber is sleeved outside the restricting mechanism, and ends of the shock absorber are respectively press fit with the upper base and the lower base.

Further, the restricting mechanism includes a main body and a pull rod, the main body is an electric push rod, an air cylinder or a hydraulic oil cylinder, one end of the main body is provided with a through hole, and the pull rod movably extends through the through hole. A stopper is provided at the pull rod end extending through the through hole, and the stopper cooperates with the through hole to provide a block function.

Further, the main controller is set with multiple acceleration thresholds, and the multiple acceleration thresholds are in an arithmetic sequence; the main controller is configured to control a displacement distance of the restricting mechanism according to the gravitational acceleration, to restrict the maximum allowable length of the shock absorber which is positively correlated with the gravitational acceleration.

Further, the multiple acceleration thresholds include 1.2G, 1.4G, 1.6G, 1.8G, and 2.0G, and a ratio of the maximum allowable length of the shock absorber restricted by the restricting mechanism to a free length of the shock absorber includes ½, ⅝, ¾, ⅞ and 1;

When the gravitational acceleration is less than 1.2G, the main controller controls the restricting mechanisms to restrict the maximum allowable length of the shock absorbers to ½ the free length; when the gravitational acceleration is between 1.2G and 1.4G, the main controller controls the restricting mechanisms to restrict the maximum allowable length of the shock absorber to ⅝ the free length;

When the gravitational acceleration is between 1.4G and 1.6G, the main controller controls the restricting mechanisms to restrict the maximum allowable length of the shock absorbers to ¾ the free length; when the gravitational acceleration is between 1.6G and 1.8G, the main controller controls the restricting mechanisms to restrict the maximum allowable length of the shock absorbers to ⅞ the free length; when the gravitational acceleration is between 1.8G and 2.0G, the main controller controls the restricting mechanisms to restrict the maximum allowable length of the shock absorbers to the free length.

Beneficial effects: The suspended catamaran target boat adopts the structure comprising a deck, two buoyancy units and at least two suspension assemblies. The suspension assemblies each include an upper base, a lower base and two supporting rods. The upper base and the lower base are arranged apart in an up-down direction, and the two supporting rods are arranged apart in a left-right direction and are hinged between the upper base and the lower base, where the suspension assemblies each form a four-link mechanism, so that the buoyancy units float up and down and swing left and right relative to the deck to adjust the support height and elastic strength of the suspension assemblies, meeting support requirements under different speeds, sea conditions and movement states.

The main controller, the acceleration sensor and the heel sensor are mounted on the deck, and the main controller is electrically connected with the acceleration sensor, the heel sensor, and the restricting mechanisms of the two suspension assemblies, respectively. The acceleration sensor is configured to detect deck dusting during sailing and generate a gravitational acceleration signal. According to the signal, the restricting mechanisms of the suspension assemblies are controlled to restrict the maximum allowable length of the shock absorbers to a corresponding value, so as to adjust the elastic strength and support height of the suspension assemblies, which can better adapt to the sea surface undulation during sailing; the heel sensor is configured to detect a heel degree of the deck and generate a heel angle signal, then the restricting mechanisms of the suspension assemblies are controlled to restrict the maximum allowable length of the shock absorbers to a corresponding value according to the heel angle signal, to adjust the support height of the suspension assemblies at a corresponding side to compensate for heel change of the deck when the boat turns during high maneuvering movement.

Figure 1:
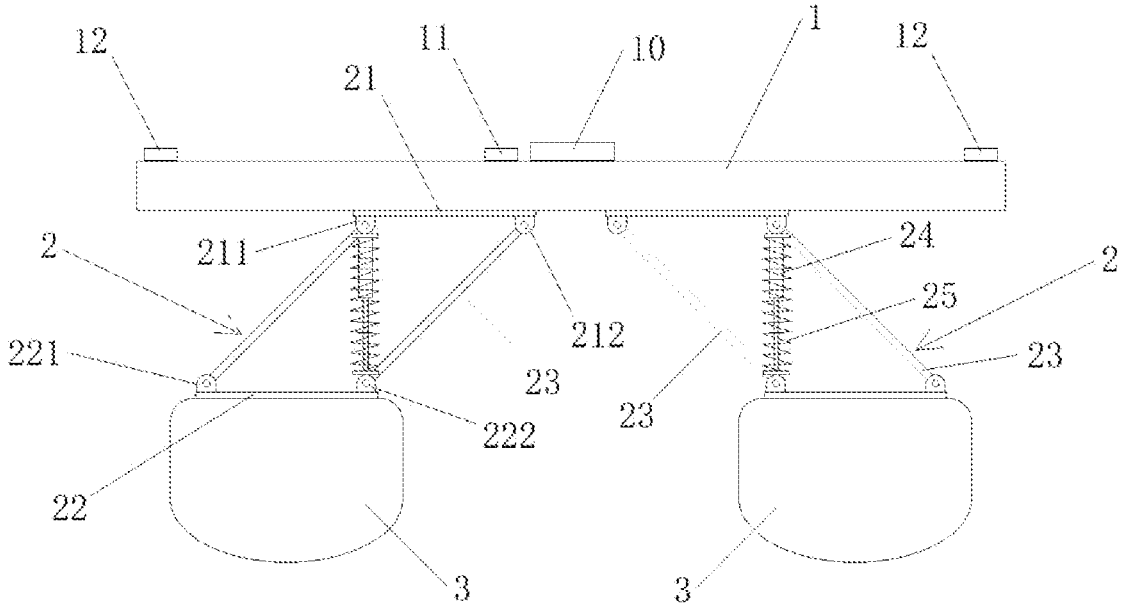
FIG. 1 is a front view schematic diagram of the suspended catamaran target boat in a specific embodiment of the present disclosure.

In the drawings: 1—deck, 10—main controller, 11—acceleration sensor, 12—heel sensor;

2—suspension assembly, 21—upper base, 211—first hinge part, 212—second hinge part;

22—lower base, 221—third hinged part, 222—fourth hinged part, 23—support rod;

24—restricting mechanism, 240—main body of the restricting mechanism, 241—through hole, 242—pull rod, 243—stopper, 25—shock absorber, 3—buoyancy unit.

DETAILED DESCRIPTION OF ILLUSTRATED EXAMPLES

The specific embodiments of the present invention will be described in further detail below with reference to the accompanying drawings and embodiments. The following embodiments are intended to illustrate the present disclosure, but not to limit the scope of the present invention.

Figure 2:
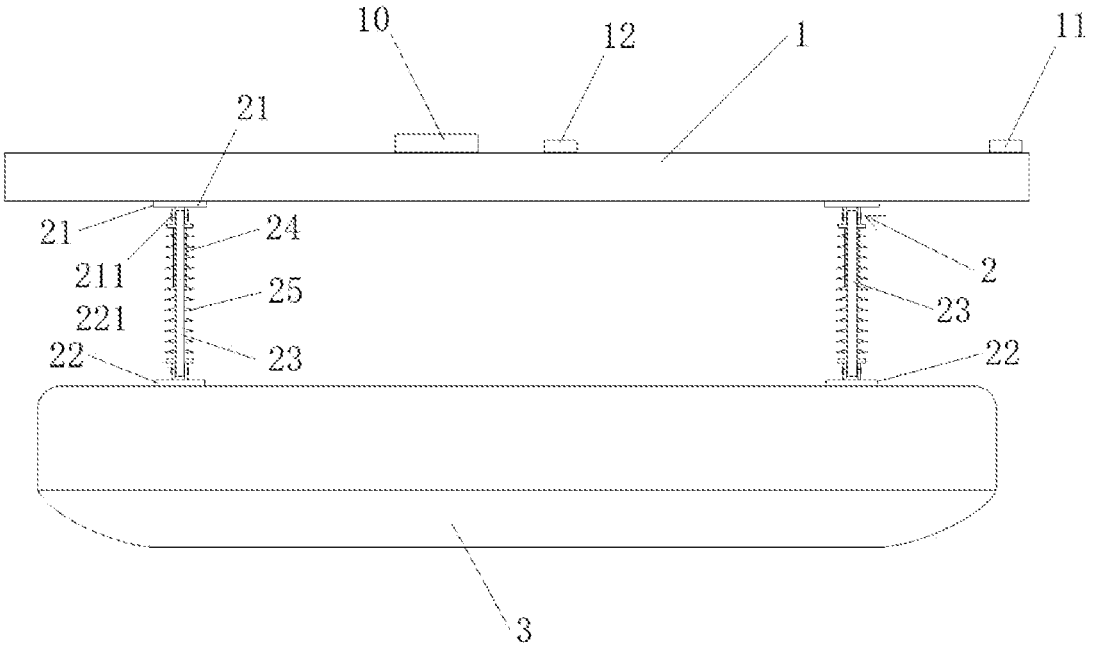
FIG. 2 is a side view schematic diagram of the suspended catamaran target boat in a specific embodiment of the present disclosure.
Figure 3:
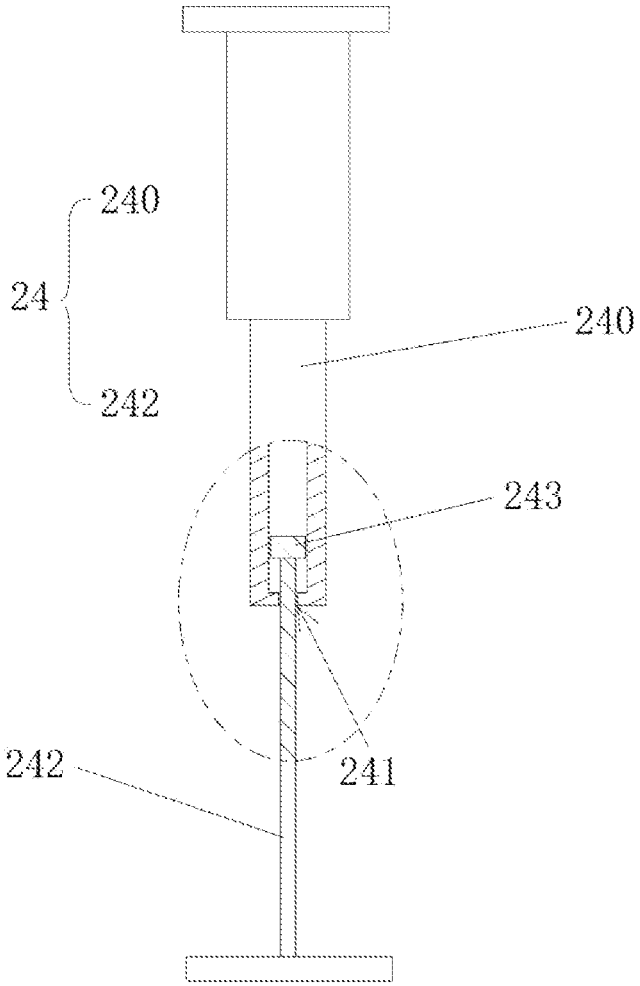
FIG. 3 is a partial cross-sectional schematic diagram of the restricting mechanism in a specific embodiment of the present invention.
Figure 4:
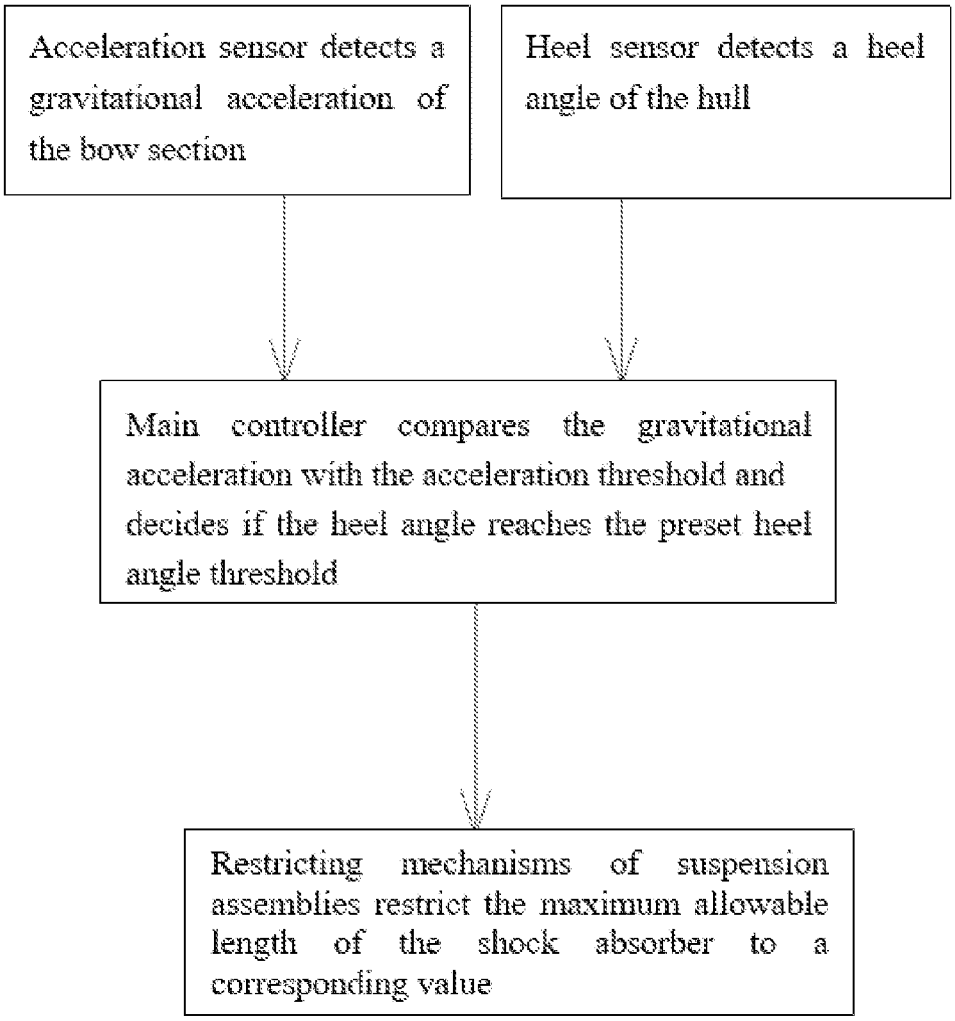
FIG. 4 is a schematic diagram of the control principle of the suspended catamaran target boat in a specific embodiment of the present disclosure.

The suspended catamaran target boat in specific embodiment 1 of the present disclosure, as shown in FIGS. 1 to 4, includes a deck 1, a suspension structure and two buoyancy units 3. The two buoyancy units 3 are arranged in parallel and spaced apart, the suspension structure is connected to upper sides of the two buoyancy units 3, and the deck 1 is mounted on the suspension structure; the suspension structure includes at least two suspension assemblies 2, and the at least two suspension assemblies 2 each include an upper base 21, a lower base 22 and two support rods 23. The upper base 21 and the lower base 22 are arranged apart in an up-down direction. The upper base 21 is fixedly connected to the deck 1, and the lower base 22 is fixedly connected with a corresponding buoyancy unit 2.

Two support rods 23 are arranged apart along a width direction of the deck 1, and the two support rods 23 are hinged between the upper base 21 and the lower base 22, where the upper base 21, the lower base 22 and the two support rods 23 form a four-bar linkage mechanism, and a shock absorber 25 and a restricting mechanism 24 are provided between the upper base 21 and the lower base 22; the main controller 10, the acceleration sensor 11 and the heel sensor 12 are also mounted on the deck 1, and the main controller 10 is electrically connected with the acceleration sensor 11, the heel sensor 12 and the restricting mechanisms 24 of the two suspension assemblies 2, respectively.

Specifically, the acceleration sensor 11 is arranged at the front of the deck 1, and it is configured to detect a gravitational acceleration of the bow section; the main controller 10 is preset with an acceleration threshold, and configured to receive an electrical signal of the gravitational acceleration detected; the gravitational acceleration detected is compared with the acceleration threshold, then main controller 10 controls the restricting mechanisms 24 to restrict a maximum allowable length of the shock absorbers 25 to a corresponding value when the gravitational acceleration reaches the set acceleration threshold. In addition, at least two heel sensors 12 are provided, which are arranged on both sides of the deck 1 along the width direction, and the heel sensors 12 are configured to detect a heel angle of the deck 1 towards a corresponding side; the main controller 10 is preset with a heel angle threshold, and configured to receive an electrical signal of the heel angle, so as to control the restricting mechanism 24 of the suspension assembly 2 on a corresponding side to restrict the maximum allowable length of the shock absorber 25 to a corresponding value when the heel angle reaches the set heel angle threshold. The restricting mechanisms 24 of the suspension assemblies 2 can be controlled to restrict the maximum allowable length of the shock absorbers 25 to a corresponding value according to the navigation dusting signal and the heel signal.

The suspended catamaran target boat adopts the structure comprising deck 1, two buoyancy units 3 and at least two suspension assemblies 2. The suspension assemblies 2 each include an upper base 21, a lower base 22 and two support rods 23. The upper base 21 and the lower base 22 are arranged apart in an up-down direction, and the two support rods 23 are arranged apart in an left-right direction and are hinged between the upper base 21 and the lower base 22, so that the suspension assemblies 2 each are four-bar linkage mechanisms, allowing the buoyancy units 3 float up and down and swing left and right relative to the deck 1 to adjust the elastic strength and support height of the suspension assemblies 2, thereby meeting support requirements under different speeds, sea conditions and movement states.

The main controller 10, the acceleration sensor 11 and the heel sensors 12 are mounted on the deck 1, and the main controller 10 is electrically connected with the acceleration sensor 11, the heel sensor 12 and the restricting mechanisms 24 of the two suspension assemblies 2, respectively. The acceleration sensor 11 is configured to detect dusting degree of the deck 1 during sailing and generate a gravitational acceleration signal. According to the signal reflecting the dusting, the restricting mechanisms 24 of the suspension assemblies 2 are controlled to restrict the maximum allowable length of the shock absorbers 25 to a corresponding value, so as to adjust the elastic strength and support height of the suspension assemblies 2, which can better adapt to the undulating sea surface during sailing; the heel sensors 12 are configured to detect a heel degree of the deck 1 and generate an electrical signal of the heel angle, and according to the heel angle, the restricting mechanism 24 of the suspension assembly 2 is controlled to restrict the maximum allowable length of the shock absorber 25 to a corresponding value to adjust the support height of the suspension assembly 2 on a corresponding side, thereby compensating for heel change of the deck 1 when the boat turns during high maneuvering movement.

In this embodiment, four suspension assemblies 2 are provided, which are two left suspension assemblies and two right suspension assemblies respectively. The left suspension assemblies and the right suspension assemblies are symmetrically arranged relative to a central axis of the boat hull, and expand outwardly from top to bottom. The two left suspension assemblies extend toward left from top to bottom, and the two right suspension assemblies extend toward right from top to bottom, increasing the lateral distance between the two buoyancy units 3 and improving high-speed sailing stability of the suspended catamaran target boat.

Wherein, the upper base 21 is provided with a first hinge part 211 and a second hinge part 212, and the first hinge part 211 and the second hinge part 212 are arranged apart along a width direction of the deck 1; the lower base 22 is provided with a third hinge part 221 and a fourth hinge part 222, the third hinge part 221 and the fourth hinge part 222 are arranged apart along a width direction of the deck 1; the first hinge part 211 and the third hinge part 221 are connected with a first support rod, the second hinge part 212 and the fourth hinge part 222 are connected with a second support rod, and the first support rod and the second support rod are the above-mentioned two support rods 23.

Specifically, the distance between the first hinge part 211 and the second hinge part 212 of the upper base 21 is D1, and the distance between the third hinge part 221 and the fourth hinge part 222 of the lower base 22 is D2, D1=D2; the length of the first support rod is L1, the length of the second support rod is L2, and L1=L2. That is to say, the upper base 21, the lower base 22 and the two support rods 23 form a mechanism in parallelogram. When the suspension assembly 2 swing, the lower base 22 is always kept parallel to the upper base 21, ensuring that the two buoyancy units 3 only float relative to the deck 1, thereby the buoyancy units 3 have stable and unchanged draft.

In addition, the restricting mechanism 24 is connected between the first hinge part 211 of the upper base 21 and the fourth hinge part 222 of the lower base 22, the shock absorber 25 is sleeved outside the restricting mechanism 24, with its ends press-fitted with the upper base 21 and the lower base 22 respectively. Specifically, the restricting mechanism 24 includes a main body 240 and a pull rod 242. The main body 240 is an electric push rod, an air cylinder or a hydraulic oil cylinder. One end of the main body 240 is provided with a through hole 241, and the pull rod 242 movably extends through the through hole 241 of the main body 240; the end of the pull rod 242 extending through the through hole is provided with a stopper 243, which cooperates with the through hole 241 to provide a block function.

When dusting occurs during sailing, the suspension assemblies 2 each are subjected to an impact force and then compress the shock absorbers 25. Each of the pull rod 242 movably extends through the through hole 242 of the main body 240, and can freely retract into the main body 240, realizing the purpose of alleviating the navigation dusting through the shock absorber 25. When it is necessary to actively control the support conditions of the suspension assemblies 2, the pull rods 242 are driven by retraction displacement of the main bodies 240, which scales down the maximum allowable length of the shock absorbers 25, and at the same time, reduces the support height of the suspension assemblies and enhances the elastic strength of the suspension assemblies.

In this embodiment, the main controller 10 is preset with multiple acceleration thresholds, which are distributed in an arithmetic progression, including 1.2G, 1.4G, 1.6G, 1.8G, and 2.0G. The ratio of the maximum allowable length of the shock absorber 25 restricted by the restricting mechanism 24 to the free length of the shock absorber 25 includes ½, ⅝, ¾, ⅞, 1, and the restricting mechanisms 24 are controlled according to the gravitational acceleration detected by the acceleration sensor 11 to restrict the maximum allowable length of the shock absorbers 25 to a corresponding value.

When the gravitational acceleration is less than 1.2G, the main controller 10 controls the restricting mechanisms 24 to restrict the maximum allowable length of the shock absorbers 25 to ½ the free length, and when the gravitational acceleration is between 1.2G and 1.4G, the main controller 10 controls the restricting mechanisms 24 to restrict the maximum allowable length of the shock absorbers 25 to ⅝ the free length; when the gravitational acceleration is between 1.4G and 1.6G, the main controller 10 controls the restricting mechanisms 24 to restrict the maximum allowable length of the shock absorbers 25 to ¾ the free length; when the gravitational acceleration is between 1.6G and 1.8G, the main controller 10 controls the restricting mechanisms 24 to restrict the maximum allowable length of the shock absorbers 25 to ⅞ the free length; when the gravitational acceleration is between 1.8G and 2.0G, the main controller 10 controls the restricting mechanisms 24 to restrict the maximum allowable length of the shock absorbers 25 to the full free length.

When the boat sailing is in a stable state, the restricting mechanisms 24 compress the shock absorbers 25 to half of the free length. At this time, the elastic support force of the shock absorbers 25 are large, which ensures that the deck 1 maintains better balance; with the dusting degree aggravating, the gravitational acceleration detected at the bow section increases, the restricting mechanisms 24 extend the pull rods 242 step by step, to increase the maximum allowable length of the shock absorbers 25 to corresponding values, which increases the support height of the suspension assemblies 2 and reduce the elastic strength of the suspension assemblies 2, adapting to the sea surface conditions during sailing.

In this embodiment, the heel angle threshold set in the main controller 10 is 5°. When the heel sensors 12 detect that the deck heels to the left by 3°, the heel angle does not reach the set heel angle threshold, and there is no need to control the restricting mechanisms of the suspension assemblies 2 to compensate the heel motion; when the heel sensors 12 detect that the deck heels to the left by 10°, where the heel angle exceeds the set heel angle threshold, the restricting mechanisms 24 of the left suspension assemblies are released to increase the maximum allowable length of the shock absorbers 25 to the corresponding values, and the lateral compression deformation of the suspension is compensated by expansion action of the shock absorbers 25, so as to ensure turning balance of the deck 1 and avoid the hull capsizing during high maneuvering sailing.

The above are only the preferred embodiments of the present invention. It should be pointed out that for those skilled in the art, without departing from the technical principle of the present invention, several improvements and replacements can be made. These improvements and replacements should also be regarded as falling in the protection scope of the present invention.

The invention claimed is:

1. A suspended catamaran target boat, comprising a deck, a suspension structure and two buoyancy units, the two buoyancy units are arranged in parallel and spaced apart, and the suspension structure is connected to upper sides of the two buoyancy units, the deck is mounted on the suspension structure;

the suspension structure comprises at least two suspension assemblies, the at least two suspension assemblies each include an upper base, a lower base and two support rods, the upper base and the lower base are arranged apart in an up-down direction, the upper base is fixedly connected with the deck, and the lower base is fixedly connected with a corresponding buoyancy unit;

the two support rods are arranged apart along a width direction of the deck, and the two support rods are hinged between the upper base and the lower base; the upper base, the lower base and the two support rods form a four-bar linkage mechanism, and a shock absorber and a restricting mechanism are installed between the upper base and the lower base;

the deck is provided with a main controller, an acceleration sensor and a heel sensor, and the main controller is respectively electrically connected to the acceleration sensor, the heel sensor and the restricting mechanisms of the two suspension assemblies;

the acceleration sensor is arranged at the front of the deck to detect a gravitational acceleration of a bow section; the main controller is preset with an acceleration threshold, and is configured to receive an electrical signal of the gravitational acceleration and compare the gravity acceleration with the acceleration threshold, so as to control the restricting mechanisms to restrict a maximum allowable length of the shock absorbers to a corresponding value when the gravitational acceleration reaches the preset acceleration threshold;

at least two heel sensors are provided, and the at least two heel sensors are arranged on both sides of the deck along its width direction to detect an heel angle of the deck towards a corresponding side; the main controller is preset with an heel angle threshold, and is configured to receive an electric signal of the heel angle, and control the restricting mechanism of the suspension assembly on a corresponding side to restrict the maximum allowable length of the shock absorber to a corresponding value when the heel angle reaches the preset heel angle threshold.

2. The suspended catamaran target boat according to claim 1, wherein four suspension assemblies are provided, which are two left suspension assemblies and two right suspension assemblies respectively, and the left suspension assemblies and the right suspension assemblies are symmetrically arranged with respect to a central axis of the deck, and the left suspension assemblies and the right suspension assemblies are arranged in an outwardly expanding shape from top to bottom.

3. The suspended catamaran target boat according to claim 2, wherein the upper base is provided with a first hinge part and a second hinge part, and the first hinge part and the second hinge part are arranged apart along a width direction of the deck;

the lower base is provided with a third hinge part and a fourth hinge part, and the third hinge part and the fourth hinge part are arranged apart along a width direction of the deck;

the first hinge part and the third hinge part are connected through a first support rod, and the second hinge part and the fourth hinge part are connected through a second support rod.

4. The suspended catamaran target boat according to claim 3, wherein a distance between the first hinge part and the second hinge part is D1, a distance between the third hinge part and the fourth hinge part is D2, and D1=D2; a length of the first rod is L1, a length of the second rod is L2, and L1=L2.

5. The suspended catamaran target boat according to claim 3, wherein the restricting mechanism is connected between the first hinge part and the fourth hinge part, the shock absorber is sleeved outside the restricting mechanism, and ends of the shock absorber are press fit with the upper base and the lower base respectively.

6. The suspended catamaran target boat according to claim 5, wherein the restricting mechanism comprises a main body and a pull rod, the main body is an electric push rod, an air cylinder or a hydraulic oil cylinder, one end of the main body is provided with a through hole, and the pull rod movably extends through the through hole; a stopper is provided at the pull rod end extending through the through hole, and the stopper cooperates with the through hole to provide a block function.

7. The suspended catamaran target boat according to claim 1, wherein the main controller is set with multiple acceleration thresholds, and the multiple acceleration thresholds are in an arithmetic sequence; the main controller is configured to control the restricting mechanism according to the gravitational acceleration, to restrict the maximum allowable length of the shock absorber which is positively correlated with the gravitational acceleration.

8. The suspended catamaran target boat according to claim 7, wherein the multiple acceleration thresholds include 1.2G, 1.4G, 1.6G, 1.8G, and 2.0G, and a ratio of the maximum allowable length of the shock absorber restricted by the restricting mechanism to a free length of the shock absorber includes ½, ⅝, ¾, ⅞, 1;

when the gravitational acceleration is less than 1.2G, the main controller controls the restricting mechanism to restrict the maximum allowable length of the shock absorber to ½ the free length; when the gravitational acceleration is between 1.2G and 1.4G, the main controller controls the restricting mechanism to restrict the maximum allowable length of the shock absorber to ⅝ the free length;

when the gravitational acceleration is between 1.4G and 1.6G, the main controller controls the restricting mechanism to restrict the maximum allowable length of the shock absorber to ¾ the free length; when the gravitational acceleration is between 1.6G and 1.8G, the main controller controls the restricting mechanism to restrict the maximum allowable length of the shock absorber to ⅞ the free length; when the gravitational acceleration is between 1.8G and 2.0G, the main controller controls the restricting mechanism to restrict the maximum allowable length of the shock absorber to the full free length.

* * * * *